US010967596B2

(12) United States Patent
Grant et al.

(10) Patent No.: US 10,967,596 B2
(45) Date of Patent: Apr. 6, 2021

(54) BALER WITH PLATEN BYPASS PREVENTION FEATURES

(71) Applicant: Wastequip, LLC, Charlotte, NC (US)

(72) Inventors: David Michael Grant, Blackwood, NJ (US); Douglas Alan Chojecki, San Antonio, TX (US); Kirk David Warren, Cherry Hill, NJ (US)

(73) Assignee: Wastequip LLC, Charlotte, NC (US)

( * ) Notice: Subject to any disclaimer, the term of this patent is extended or adjusted under 35 U.S.C. 154(b) by 417 days.

(21) Appl. No.: 15/914,005

(22) Filed: Mar. 7, 2018

(65) Prior Publication Data

US 2019/0275758 A1 Sep. 12, 2019

(51) Int. Cl.

| | |
|---|---|
| ***B30B 9/30*** | (2006.01) |
| ***B30B 15/04*** | (2006.01) |
| ***B65B 63/02*** | (2006.01) |

(52) U.S. Cl.

CPC ..... *B30B 9/3082* (2013.01); *B30B 9/306* (2013.01); *B30B 9/3007* (2013.01); *B30B 9/3042* (2013.01); *B30B 15/041* (2013.01); *B65B 63/02* (2013.01)

(58) Field of Classification Search

CPC ..... B30B 15/26; B30B 15/28; B30B 15/041; B30B 9/306; B30B 9/3007; B30B 9/3014; B30B 9/3028; B30B 9/3032; B30B 9/3042; B30B 9/3057; B30B 9/3082; B65B 63/02; B65B 27/12

See application file for complete search history.

(56) References Cited

U.S. PATENT DOCUMENTS 3,842,729 A * 10/1974 Mandrup ..... B30B 1/006 100/229 A
3,851,577 A * 12/1974 Newcom ..... B30B 9/3014 100/218
3,855,919 A * 12/1974 Potter ..... B30B 9/3007 100/52

(Continued)

OTHER PUBLICATIONS

ANSI Z245.5-2013, Baling Equipment—Safety Requirements for Installation, Maintenance, Modification, Repair, and Operation, May 1, 2013.

(Continued)

*Primary Examiner* — Jimmy T Nguyen
(74) *Attorney, Agent, or Firm* — Nelson Mullins Riley & Scarborough LLP

(57) ABSTRACT

A baler and methods of operating a baler. The baler includes a housing defining an interior volume, the interior volume including a compression portion and a loading portion. The baler also includes a first closure movably coupled with the housing and operative to enclose the compression portion and a second closure movably coupled with the housing and operative to enclose the loading portion. Further, the baler includes a reciprocating compression assembly including a linear actuator and a platen operably coupled with the linear actuator. The platen is movable between a retracted position and an extended position in response to actuation of the linear actuator. Additionally, the first closure defines at least one recess therein and a lip extending about at least a portion of the at least one recess. The lip is operative to engage with compressible material disposed in the compression portion.

18 Claims, 13 Drawing Sheets

(56) References Cited

U.S. PATENT DOCUMENTS

| | | | | | |
|---|---|---|---|---|---|
| 3,962,964 | A | * | 6/1976 | Engebretsen | B30B 9/3007 100/51 |
| 4,182,236 | A | | 1/1980 | Greer | |
| 4,311,092 | A | * | 1/1982 | Tea | B30B 9/3057 100/214 |
| 4,700,623 | A | * | 10/1987 | Durbin | B30B 1/36 100/100 |
| 5,575,199 | A | * | 11/1996 | Yamamoto | B30B 9/3003 100/220 |
| 6,055,902 | A | * | 5/2000 | Harrop | B30B 9/3007 100/229 A |
| 6,167,803 | B1 | * | 1/2001 | Schwelling | B30B 9/3032 100/215 |
| 6,694,869 | B2 | * | 2/2004 | Sutton | B30B 1/34 100/218 |
| 9,248,620 | B2 | | 2/2016 | McDonald et al. | |

OTHER PUBLICATIONS

ANSI 7245.51-2013, Baling Equipment—Safety Requirements for Manufacturing and Reconstruction, May 1, 2013.
Wastequip, 6030HD Vertical Baler Brochure, May 2009.

* cited by examiner

BALER WITH PLATEN BYPASS PREVENTION FEATURES

TECHNICAL FIELD

Embodiments of the present invention generally relate to balers. More particularly, certain embodiments of the present invention relate to a vertical downstroke baler with platen bypass prevention features and systems and to methods for detecting baler fullness and/or monitoring component health in balers. Also, in some embodiments, a baler is configured to limit or prevent spring-back of compressible material.

BACKGROUND

Balers are utilized in various industries to compress various compressible materials, such as cardboard, scrap metal, paper, plastic, and waste. One type of baler, known as a vertical downstroke baler, is illustrated in FIG. 1. In general, baler 10 includes a housing 12. The interior of housing 12 includes a loading chamber 14 and a bale chamber 16. Access to the loading chamber is provided by a movable loading chamber closure 18, and access to the bale chamber 16 is provided via a bale chamber door 20. A lock 22 may be provided on housing 12 and bale chamber door 20 to restrict access to the bale chamber 16 during operation of baler 10. As shown, baler 10 also includes a rectangular ram, or platen, 24 operatively coupled with a hydraulic cylinder 26. In operation, material to be compressed is loaded via loading chamber 14 into housing 12, and hydraulic cylinder 26 is actuated to translate ram 24 downward, thereby compressing the loaded material. After one or more cycles of loading and compression, a bale is formed in bale chamber 16. An operator may tie the bale to maintain it in compacted form after ram 24 is raised, and the operator may then cause the bale to be removed from bale chamber 16, for example via ejection chains or an ejection plate.

SUMMARY

Some example embodiments comprise a baler with platen bypass prevention features. In this regard, a baler may be configured with one or more features that limit or prevent compressible material from bypassing the platen. Additionally, some embodiments of the baler may include features to prevent spring-back of the compressible material and/or to provide an indication that maintenance should be performed.

According to one embodiment, the present invention provides a baler comprising a housing defining an interior volume, the interior volume comprising a compression portion and a loading portion. The baler also comprises a first closure movably coupled with the housing and operative to enclose the compression portion and a second closure movably coupled with the housing and operative to enclose the loading portion. The first closure defines a first interior face that faces the interior volume when the first closure is in a closed position, and the second closure defines a second interior face that faces the interior volume when the second closure is in a closed position. Further, the baler comprises a reciprocating compression assembly comprising a linear actuator and a platen operably coupled with the linear actuator. The platen is movable between a retracted position and an extended position in response to actuation of the linear actuator. The second interior face of the second closure is substantially aligned with the first interior face of the first closure when the first and second closures are in their respective closed positions.

In yet another embodiment, the present invention provides a baler comprising a housing defining an interior volume, the interior volume comprising a compression portion and a loading portion. The baler also comprises a first closure movably coupled with the housing and operative to enclose the compression portion and a second closure movably coupled with the housing and operative to enclose the loading portion. Further, the baler comprises a reciprocating compression assembly comprising a linear actuator and a platen operably coupled with the linear actuator. The platen is movable between a retracted position and an extended position in response to actuation of the linear actuator. Additionally, the first closure defines at least one recess therein and a lip extending about at least a portion of the at least one recess, the lip operative to engage with compressible material disposed in the compression portion.

According to a further embodiment, the present invention provides a baler comprising a housing defining an interior volume, the interior volume comprising a compression portion and a loading portion. The baler also comprises a first closure movably coupled with the housing and operative to enclose the compression portion and a second closure movably coupled with the housing and operative to enclose the loading portion. Further, the baler comprises a reciprocating compression assembly comprising a linear actuator and a platen operably coupled with the linear actuator. The platen is movable between a retracted position and an extended position in response to actuation of the linear actuator. Also, the baler comprises a motor, a current sensor operative to measure a current value associated with the motor, and a processor and memory including computer program code. The memory and the computer program code are configured to, with the processor, cause the processor to receive sensor data from the current sensor, determine if the sensor data exceeds a predetermined maintenance threshold, and cause an alert in response to the sensor data exceeding the predetermined maintenance threshold.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

Figure 8A:
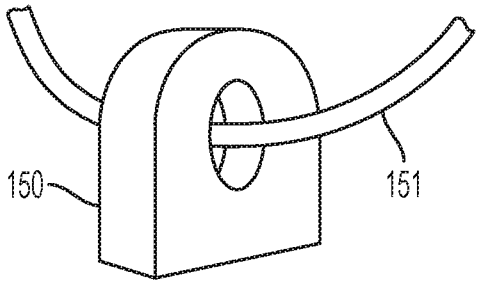
Figure 8B:
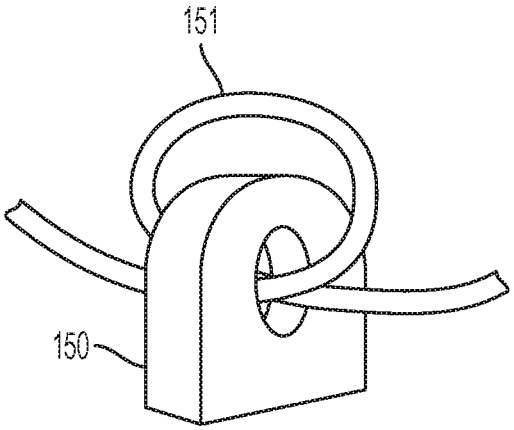
Figure 9:
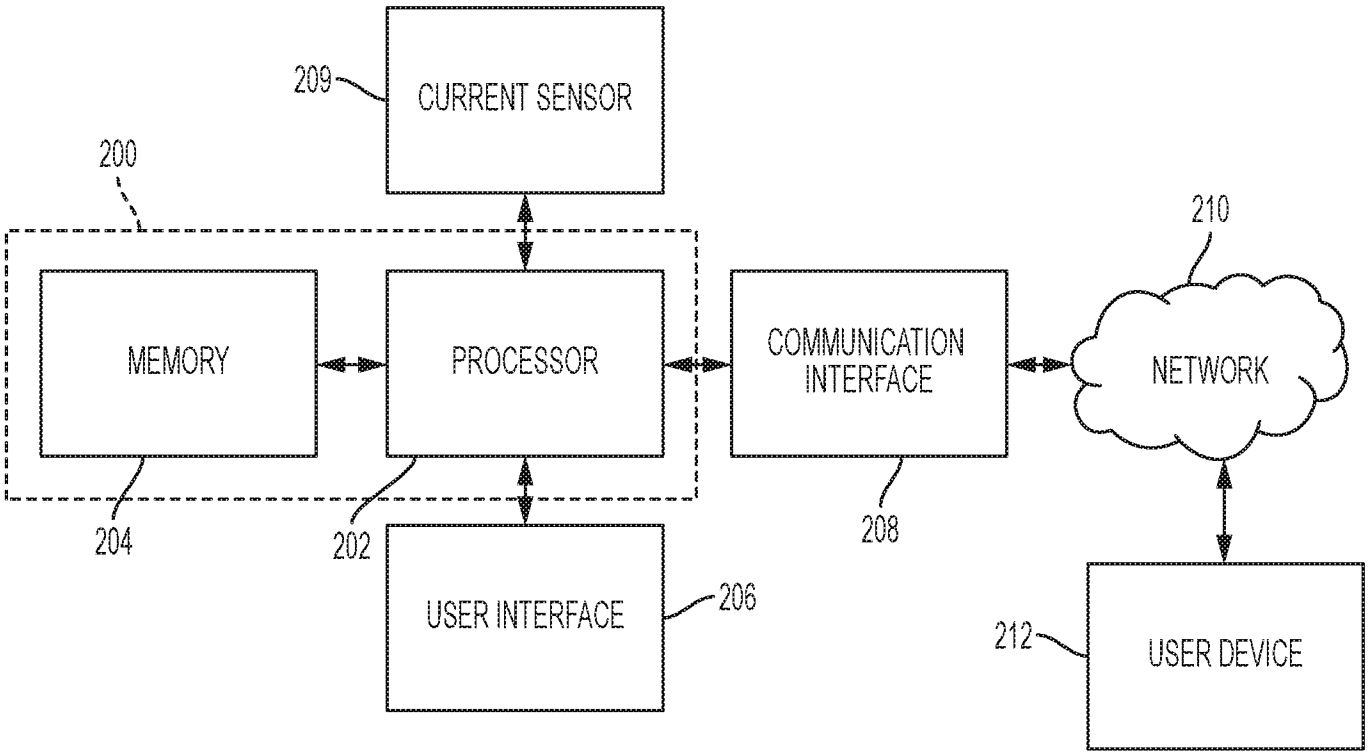
Figure 10:
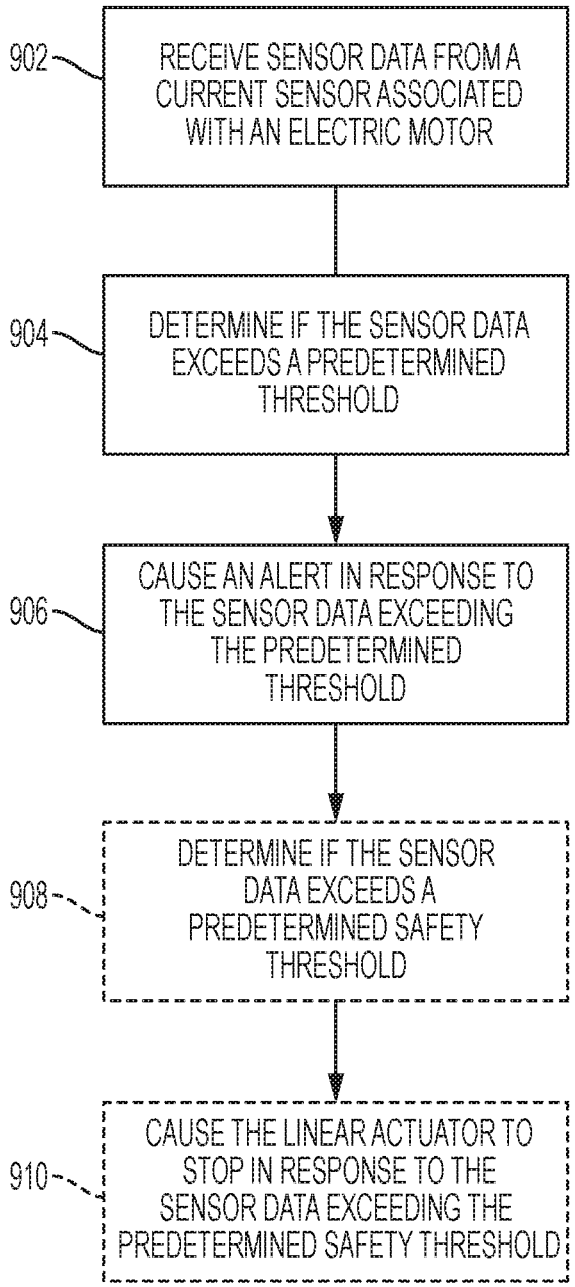

FIGS. 8A-B are diagrammatic perspective views of current sensors according to embodiments of the present invention;

FIG. 9 is a block diagram of processing circuitry for a baler according to an embodiment of the present invention; and FIG. 10 is a flow diagram illustrating steps of a method of utilizing a baler in accordance with an embodiment of the present invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of a baler, such as but not limited to "vertical," "horizontal," "upper," "lower," "front," or "rear," refer to directions and relative positions with respect to the baler's orientation in its normal intended operation, as indicated in the Figures herein. Thus, for instance, the terms "vertical" and "upper" refer to the vertical direction and relative upper position in the perspectives of the Figures and should be understood in that context, even with respect to an apparatus that may be disposed in a different orientation. The term "substantially," as used herein, should be interpreted as "nearly" or "close to", such as to account for design and manufacturing tolerances of the apparatus.

One drawback of current vertical downstroke balers is that the closure for the loading portion of the balers is spaced back, or offset, from the platen, which creates a gap between the closure and the platen large enough to allow compressible material to bypass and, in some cases, pile on top of, the ram or platen. This material may cause the platen and/or hydraulic cylinder to jam, safety sensors to trigger, or other problems which may limit or prevent movement of the platen. Further, in some cases, the compressible material may be susceptible to "spring-back." Spring-back may be an undesirable expansion of the compressible material after compacting, and it is a partial cause of the aforementioned drawback. However, spring-back can also prevent full loading of the baler due to previously compressed material not retaining its compressed volume when ram pressure is removed and thereby blocking the loading chamber of the baler. Another common problem is lack of sufficient maintenance, which may be due to unskilled workers or workers' unfamiliarity with proper maintenance requirements and practices. The failure to perform maintenance may reduce the efficiency of the baler and may lead to damage to one or more baler components.

Accordingly, embodiments of the present invention relate to a baler configured to prevent or reduce the likelihood of material bypassing the platen. In one such embodiment, the baler may include a loading gate and chamber door configured such that an interior side of the loading gate is vertically aligned with the chamber gate. Further, the gate may be positioned closer to, and in some embodiments, substantially adjacent the platen in order to eliminate the gap described above. During operation, compressible material is restricted from bypassing the platen.

In addition or in the alternative, in some embodiments, a baler may be configured to limit or prevent spring-back of compressible material. For instance, the baler may comprise a chamber door wherein at least a portion of the interior face of the chamber door is recessed to define a lip extending around some or all of the periphery of the interior of the chamber door. In this regard, the lip is preferably defined at least proximate an interface of the loading gate and the chamber door. Thereby, the lip may provide further resistance to expansion of compressed material in response to moving the rectangular platen to the retracted position. In some embodiments, the baler may also be provided with one or more projecting teeth on one or more interior surfaces, such as the interior surface of the chamber door. As those of skill in the art will appreciate, the teeth may also assist in reducing spring-back of compressed material. However, the projecting teeth are not required in all embodiments.

Also, in some embodiments, the baler preferably comprises automated maintenance scheduling and/or identification functionality. In one embodiment, a baler may be operative to cause an alert, such as an audio or visual cue to a user, when a predetermined maintenance criterion is identified or satisfied. Also, the baler may comprise sensors that require reduced maintenance with respect to similar sensors on current balers. Embodiments of the present invention may identify a need for maintenance earlier than at present and may alert operators to the need for maintenance or schedule such maintenance. Correspondingly, embodiments of the present invention may also reduce wear and tear on a baler, may increase efficiency of a baler, and may reduce the overall maintenance required.

For example, in addition to or in place of conventional pressure sensors, the baler may include a current sensor configured to measure a current value associated with an electric motor associated with a linear actuator operative to move the platen. Where, for example, the linear actuator is a hydraulic cylinder, an increase in resistance to movement of the platen may cause increased pressure to be applied to a hydraulic cylinder, which in turn may cause increased current flow through, or drawn by, the motor. As such, an increase in current flow may be indicative of baler fullness, a need for maintenance, and/or other need for inspection. The current sensor may send a current measurement or value to processing circuitry associated with the baler for comparison to a predetermined maintenance threshold. In an instance in which the current value exceeds the predetermined maintenance threshold, an alert may be caused locally at the baler, such as a light, buzzer, control panel text display, or the like, or remotely, such as via email, text message, voice call, or the like. Additionally, in some embodiments, the current measurement or value may also be used for safety interlocks. For example, movement of a linear actuator may be stopped in response to a current value greater than a safety threshold, which may be indicative of a jam of the platen.

Figure 1:
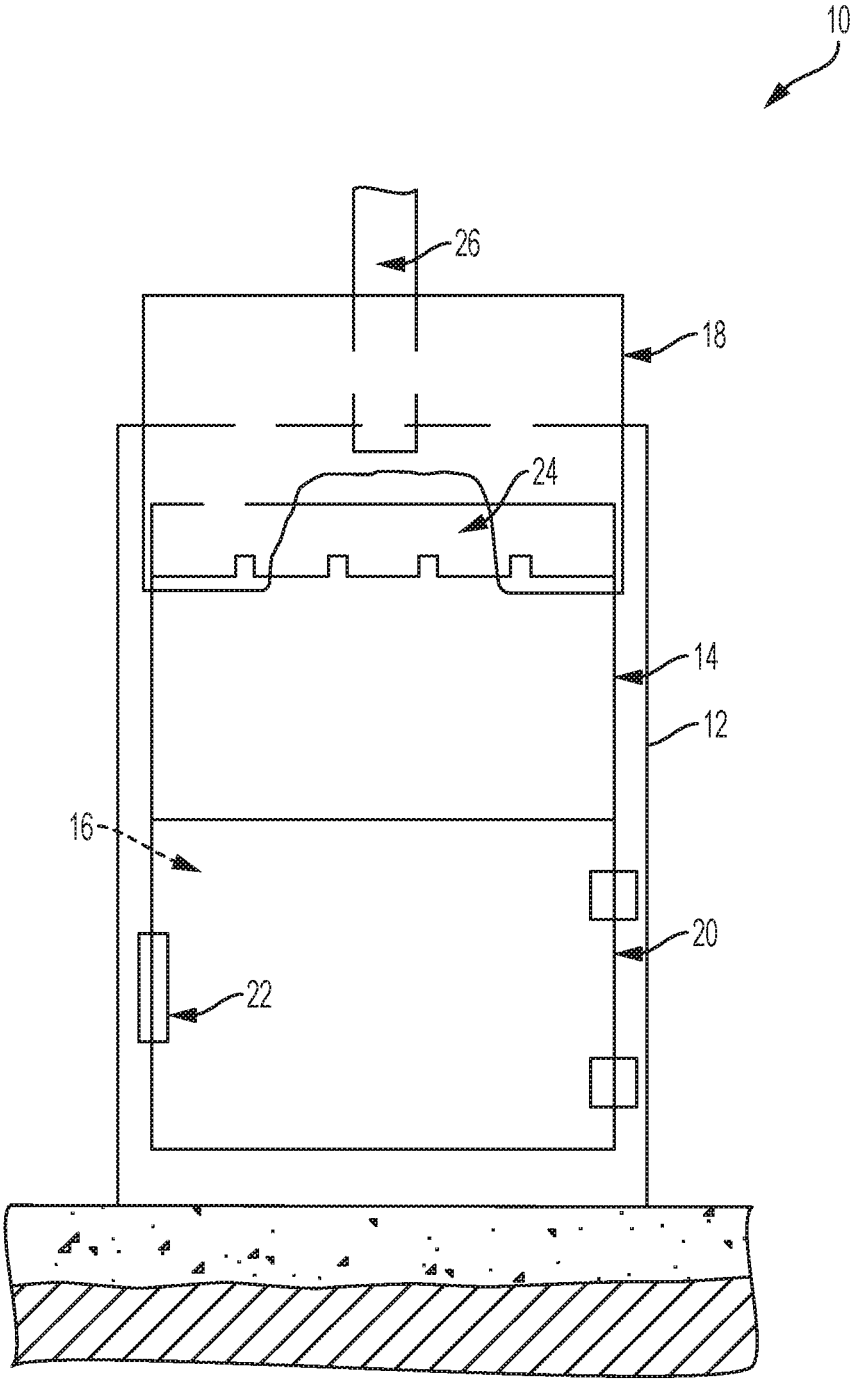
FIG. 1 PRIOR ART
FIG. 1 is a schematic illustration of a prior art vertical downstroke baler.
Figure 2:
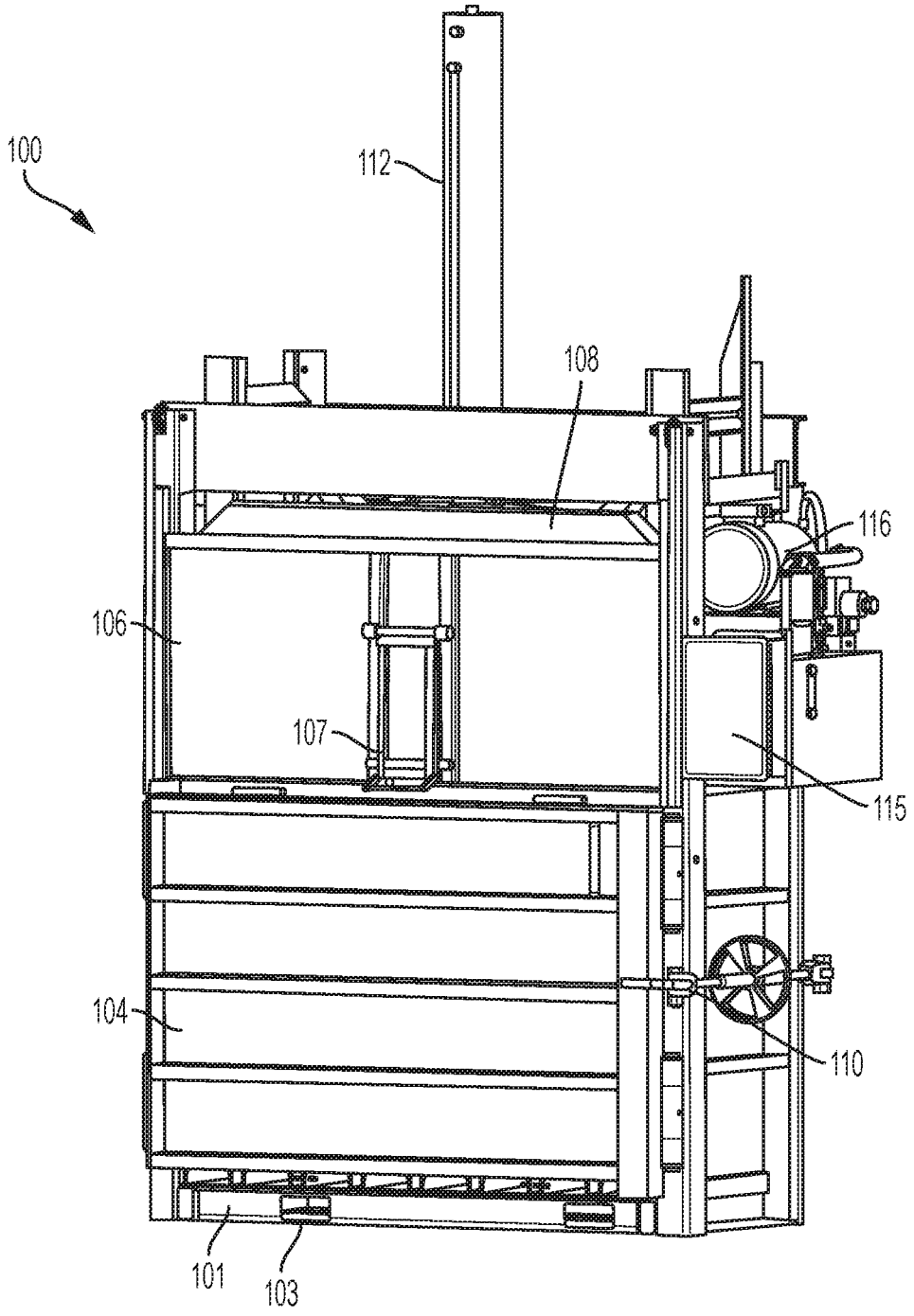
FIG. 2 is a perspective view of a baler according to an embodiment of the present invention.
Figure 3:
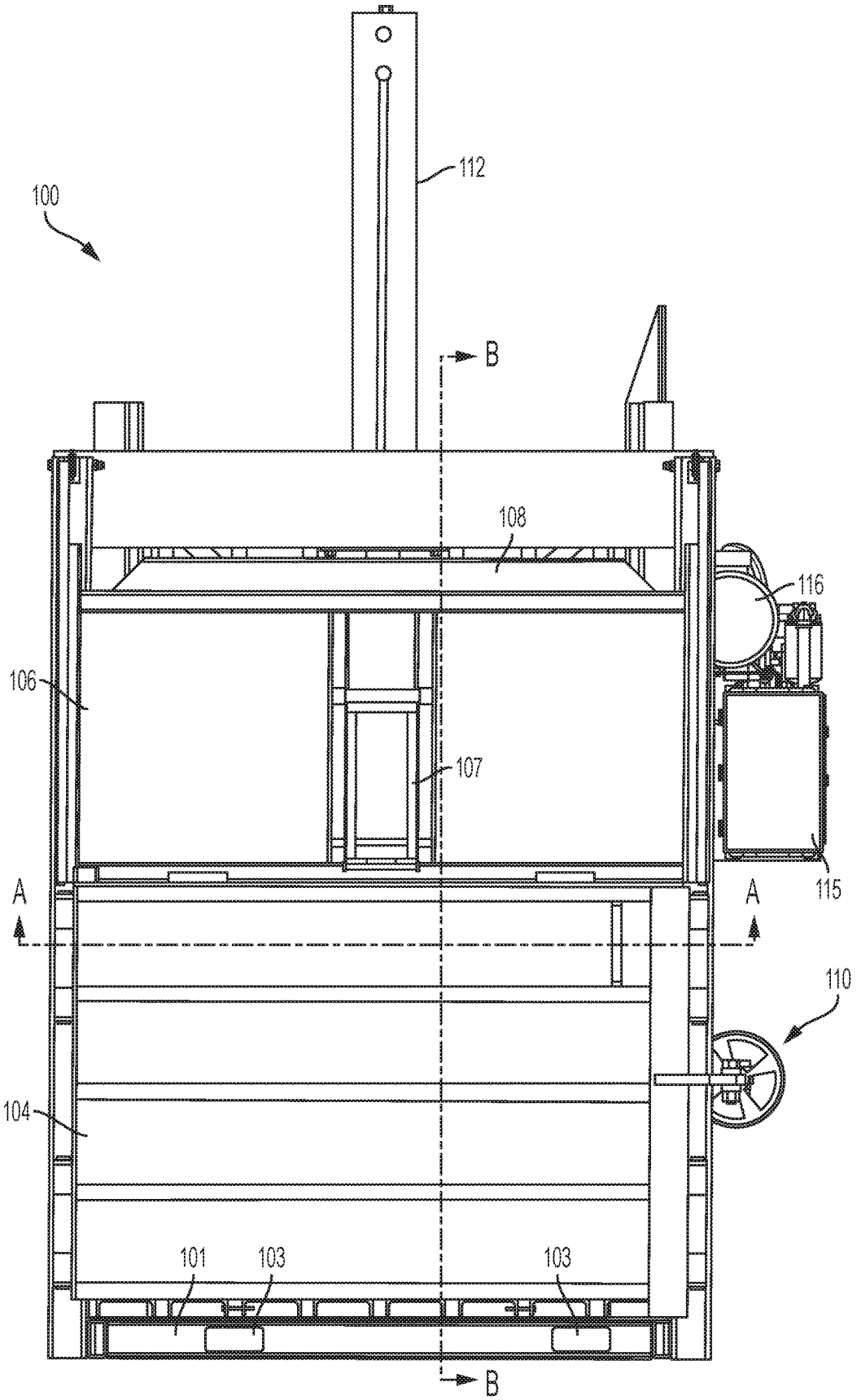
FIG. 3 is a front elevation view of the baler of FIG. 2.
Figure 4:
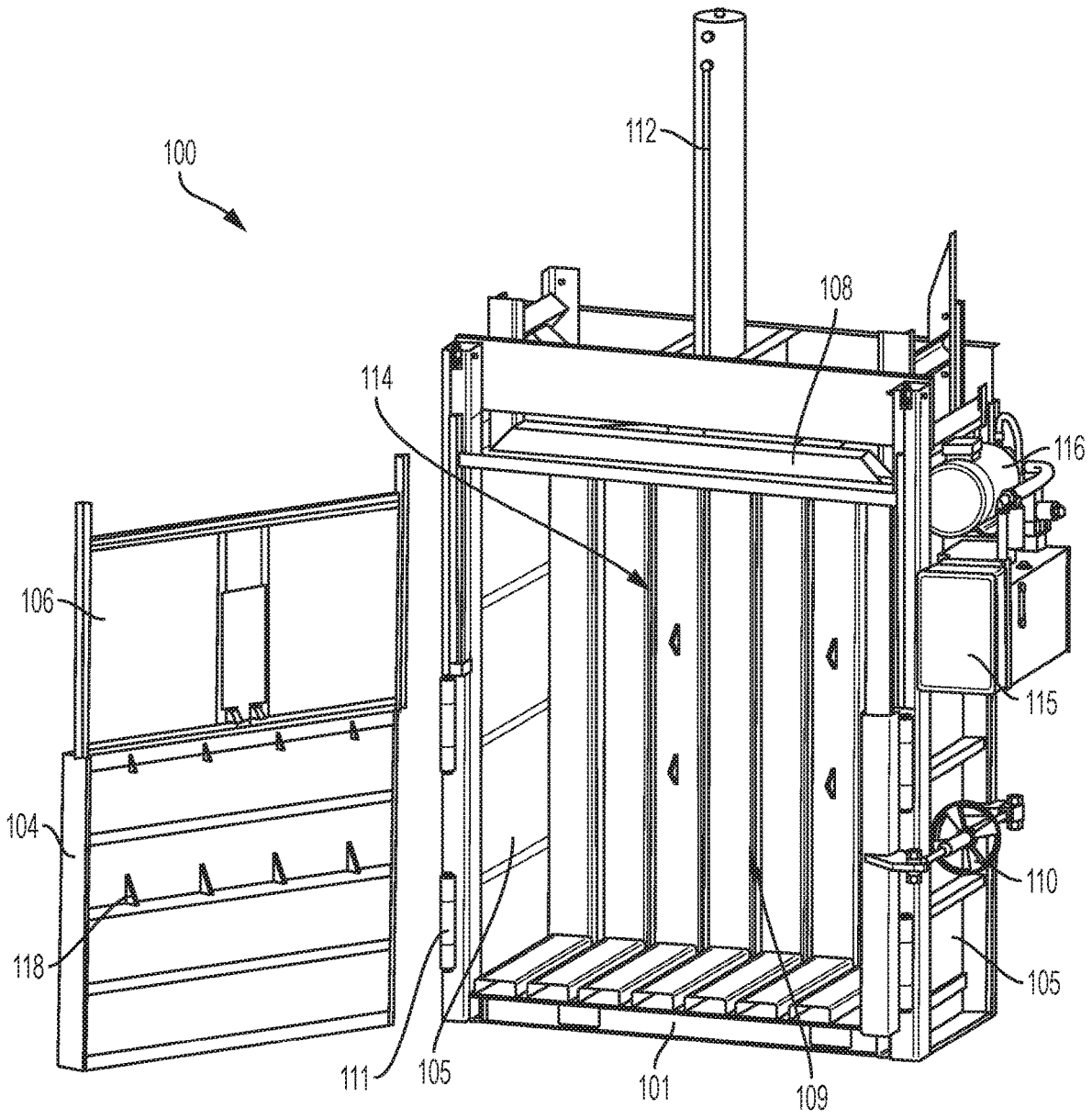
FIG. 4 is a perspective, partially exploded view of the baler of FIG. 2.
Figure 5A:
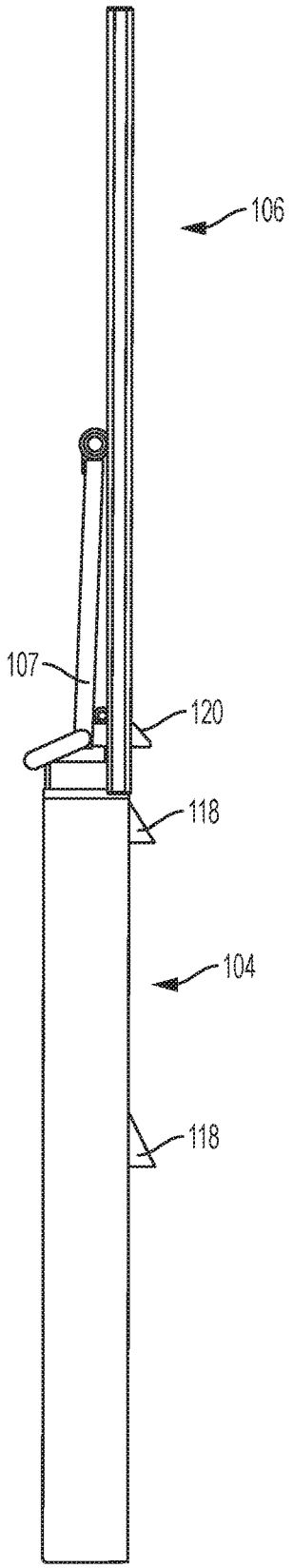
FIG. 5A is a side elevation view of the load gate and chamber door of the baler of FIG. 2, and FIGS. 5B-C are detail perspective views of the load gate and chamber door of the baler of FIG. 2.
Figure 5B:
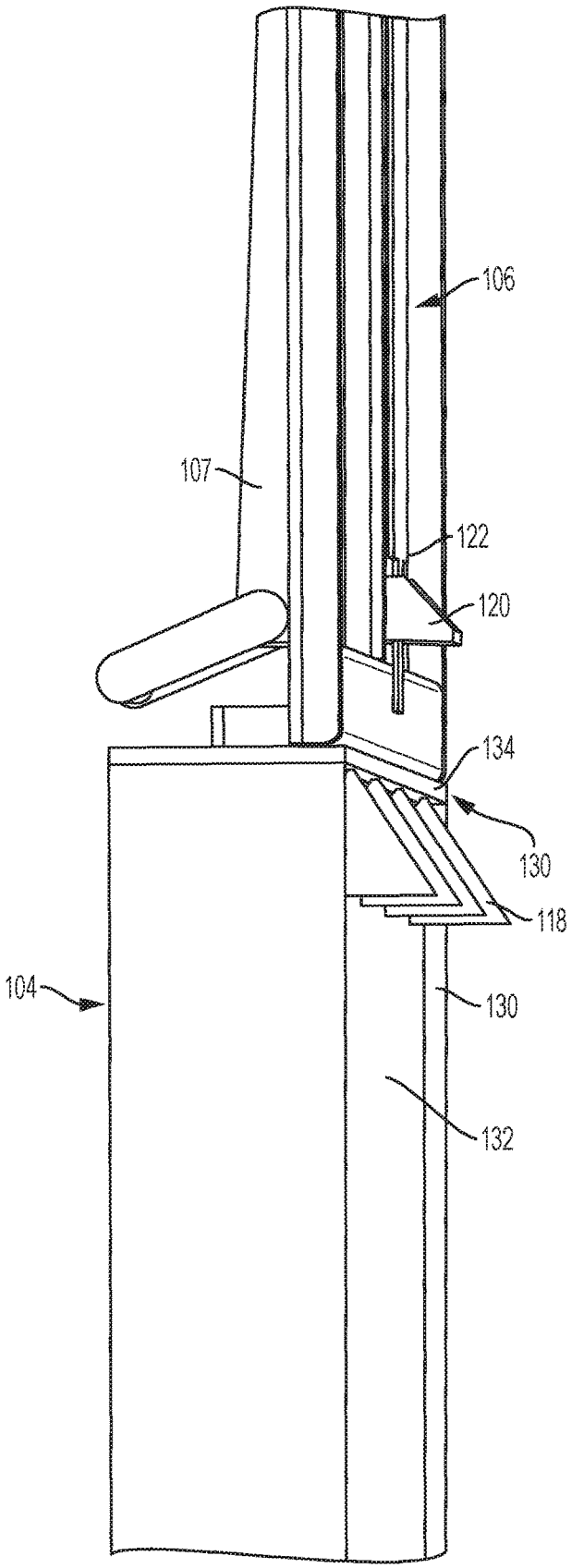
Figure 5C:
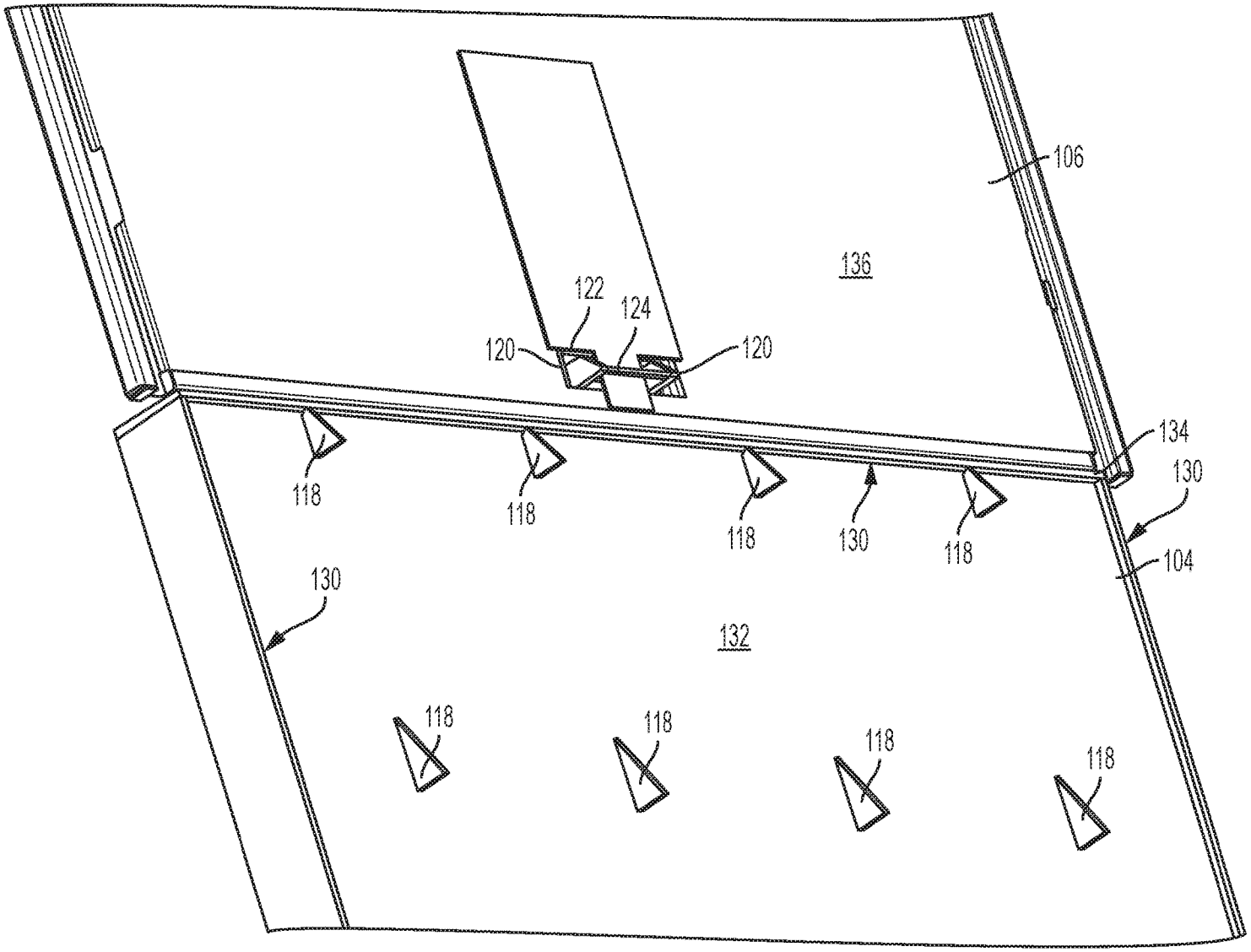

Turning now to the figures, FIGS. 2 and 4 are perspective views of a baler 100 according to an embodiment of the invention, and FIG. 3 is a front elevation view of baler 100. The baler 100 includes a base 101 which supports the baler 100 upon a support surface. The base 101 may be formed from steel or another suitable material. In some example embodiments, the base 101 may include one or more apertures 103 extending at least partially through the base 103. The apertures 103 may be configured to receive the forks of a forklift or the like to enable installation or transfer of the baler 100 from one location to another.

The baler 100 also includes a compacting chamber 114 defined by the base 101, first and second side walls 105, and a rear wall 109 (FIG. 4). The first and second side walls 105 and the rear wall 109 may be formed of steel or another material suitable to withstand the pressure applied to the compressible material in the compacting chamber 114. The compacting chamber 114 comprises a compression portion enclosed by a chamber door 104 and a loading portion enclosed by a loading gate 106. Although a gate is provided in this embodiment, those of skill in the art will appreciate that other types of loading chamber closures, including various types of loading chamber doors, may be modified for use with embodiments of the present invention.

The chamber door 104 may be formed of steel, similar to the first and second side walls 105 and the rear wall 109, and is capable of withstanding the pressure applied to the compressible material in the compacting chamber 114. The chamber door 104 may be pivotally attached to the baler 100 at a first side, such as by one or more steel hinges 111. The chamber door 104 may be operative to pivot between an open, or discharge, position, and a shut position. The chamber door 104 may be retained in the shut position, such as during loading and compacting, by a door latch 110. The door latch 110 may be any latching mechanism suitable to retain the chamber door 104 shut during compacting of the compressible material. In the depicted embodiment, the door latch 110 comprises a turnbuckle to tighten the chamber door 104 toward the shut position.

The loading gate 106, or feed gate, may be formed of steel or another material capable of withstanding some or all of the force applied to the compressible material during compacting. Here, the loading gate 106 may be configured to translate vertically between an open, or feed, position and a shut position, such as on runners disposed on either side of the opening of the loading portion of the compacting chamber 114. The loading gate 106 may include a gate latch 107 operative to raise and lower the loading gate 106. As described in more detail below, loading gate 106 may be operative to automatically open during the return stroke of the ram of baler 100. In some embodiments, gate latch 107 may also be operative to retain loading gate 106 in the shut position during compacting of the compressible material.

As shown, the baler 100 includes a reciprocating compression assembly including a rectangular platen 108 and a linear actuator 112. The platen 108 may be operably coupled, such as by a bolt, a weld, or the like to the linear actuator 112. Extension and retraction of linear actuator 112 causes movement of and provides compressive force to the platen 108, as is well understood. When baler 100 is not in operation, linear actuator 112 is not extended and platen 108 may be in a retracted position. During operation of baler 100, actuation of linear actuator 112 causes platen 108 to move toward an extended position. In one preferred embodiment, linear actuator 112 is a hydraulic cylinder, but those of skill in the art will appreciate that other types of linear actuators, including electric and pneumatic linear actuators, may also be used with embodiments of the present invention. The linear actuator 112 may have an operating pressure of 1000 psi, 2000 psi, 2200 psi, 3000 psi, or other suitable pressure. In some embodiments, the operating pressure of the linear actuator 112 may be set or adjusted based on the type of compressible material expected to be compressed by the baler 100.

Where linear actuator 112 is a hydraulic cylinder, hydraulic pressure may be supplied by a motor 116, such as a 10 HP electric motor, which may be associated with a pump, such as a 1.9 or 5.4 GPM gear pump. Motor 116 may be controlled by an operator at controller 115. The controller 115 may include processing circuitry, for example as discussed below in reference to FIG. 9, to control operations of the baler 100 and/or monitor one or more parameters associated with the baler 100. Additionally or alternatively, the controller 115 may include local control circuitry, including but not limited to switches and relays, to control the operation of the baler 100.

In operation, an operator may verify that the compacting chamber 114 is clear or empty and then shut and latch the chamber door 104 using the door latch 110. If not already in the open position, the operator may move the loading gate 106 to the open position, which opens, or exposes, the loading portion of the compacting chamber 114. The operator may place compressible materials, such as paper, cardboard, plastic, waste, or the like, into the compacting chamber 114 through the loading portion. Once a sufficient amount of compressible material has been loaded into the compacting chamber 114, the operator may move the loading gate 106 to the shut position using the gate latch 107 and may lock the loading gate. In some instances, shutting and/or latching the loading gate 106 may satisfy one or more safety interlocks, which may enable operation of the platen 108 by the controller 115.

The operator may interact with the controller 115 to cause the linear actuator 112 to move the platen 108 from the retracted position toward the extended position, thus compressing the compactable material. The controller 115, either automatically or due to operator input, may cause the platen 108 to be subsequently raised to the retracted position. As described below, return movement of platen 108 may cause loading gate 106 to automatically open. Once the platen 108 has been raised and the loading portion is accessible, the operator may continue to fill the compacting chamber 114 and compact compressible material until a suitable size bale is formed. In some instances, the baler 100 may be equipped with a sensor configured to identify when a full bale has been formed, and the controller 115 may include a light or other indication of a full bale.

To tie the bale, the operator may cause linear actuator 112 to move platen 108 toward the extended position, into engagement with the compressible material, and then the operator may open the loading gate 106 and the chamber door 104. A bale cord or wire may be fed through one or more cable guides, or gaps, in the base 101, rear wall 109, and platen 108. The operator then may tie, clamp, or otherwise engage the bale wire about the bale. After the bale has been tied, the operator may cause the platen 108 to be moved to the retracted position. If desired, a pallet or other support may be positioned in front of the compacting chamber 114 to support the bale. The bale may be ejected from the compacting chamber 114 to the pallet by an ejection chain(s) or ejection plate disposed in the base 101 and/or rear wall 109. Alternatively, the operator may manually remove the bale.

Referring now also to FIGS. 5A-7, in various embodiments, the chamber door 104, rear wall 109, and/or side walls 105 may include one or more teeth 118 that are positioned and shaped to limit expansion of compressible material in response to moving the platen 108 to the retracted position. The teeth 118 may be formed of steel or another suitable material and project into the compacting chamber 114, for example in a direction orthogonal to door 104, rear wall 109, and/or side walls 105. As the compressible material expands, the compressible material may engage one or more of the teeth 118, thereby preventing or limiting the expansion.

Figure 6A:
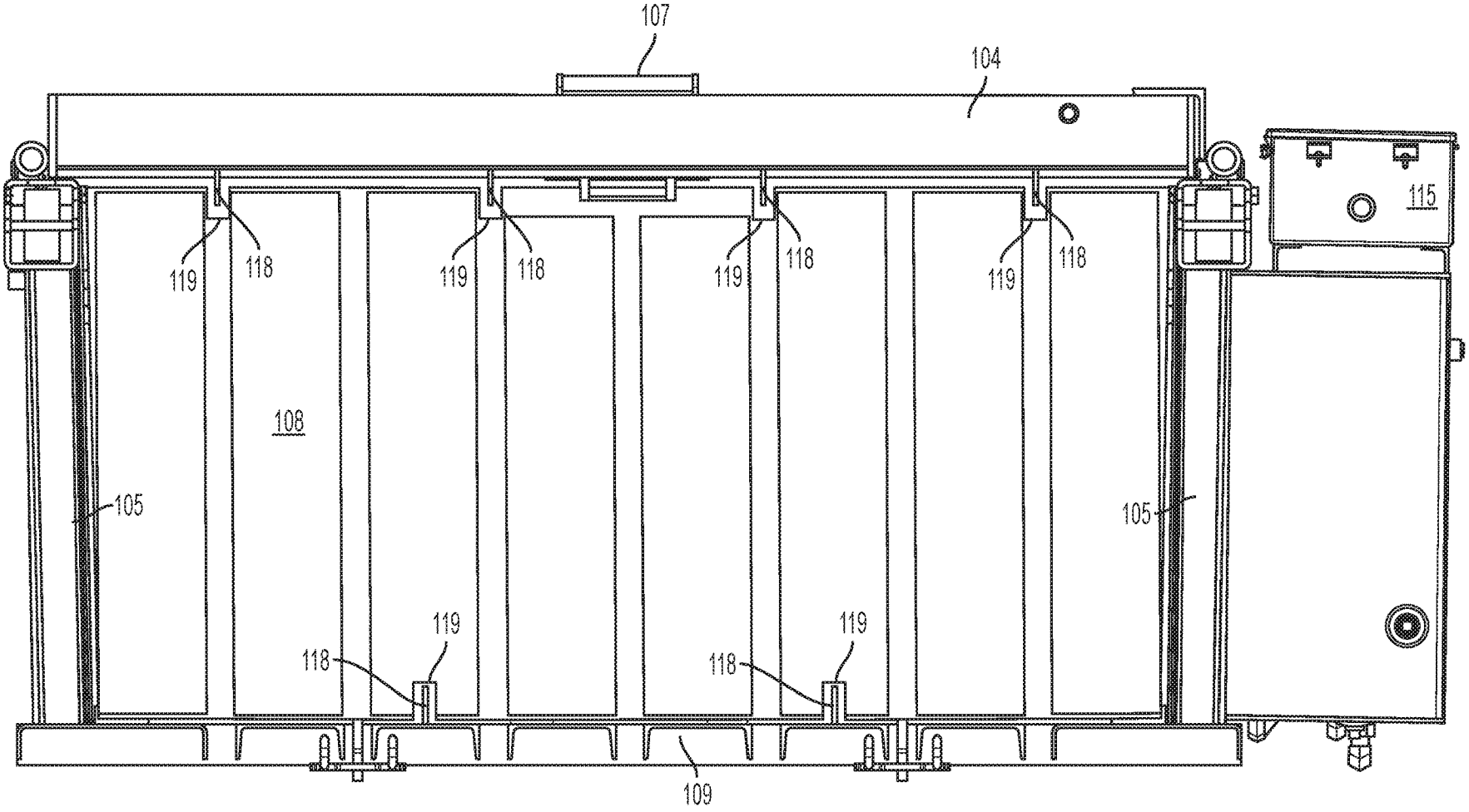
FIG. 6A is a cross-sectional view of the baler of FIG. 2 taken along the line A-A shown in FIG. 3.

As described in greater detail below, in embodiments of the invention, the periphery of the platen 108 may be proximate or substantially flush with the door 104, gate 106, rear wall 109, and side walls 105 as the platen 108 travels vertically in compacting chamber 114. To avoid interference between platen 108 and teeth 118, and as best seen in FIG. 6A, slots 119 may be defined in platen 108 in positions that generally align with the position(s) of teeth 118 in compacting chamber 114. The slots 119 are preferably sized to allow platen 108 to move past teeth 118 without interference, but the slots 119 preferably are not large enough to allow compressible material to move past and/or over platen 108. Of course, in embodiments where teeth 118 are not provided, the slots 119 may not be defined in platen 108.

In some example embodiments, the teeth 118 may define a triangular profile, though other shapes for teeth 118 are contemplated. For instance, teeth 118 on door 104 are generally in the shape of a right triangle when viewed from either side. The hypotenuse of the right triangle may face upward, with one side of the triangle against door 104. This may permit compressible material to move downwardly past teeth 118 during compression but cause teeth 118 to engage the compressible material in the event of spring-back.

Furthermore, gate latch 107 may comprise one or more teeth 120. Teeth 120 may project from gate latch 107 through corresponding aperture(s) 122 in gate 106 when gate 106 is in the shut position. Also, a bar 124 may extend between teeth 120. In embodiments where it is desired that gate 106 open automatically during the return stroke of platen 108, platen 108 may be sized and shaped such that it engages teeth 120 during its travel between the retracted and extended positions. In particular, distal ends of teeth 120 may be generally right triangular when viewed in profile (see FIGS. 5A-C & 7) so that, as platen 108 travels downward, platen will push teeth 120 and latch 107 outwardly, allowing platen 108 to pass and extend further downward. However, on its upward return stroke, platen 108 will engage the horizontal bottom edge of teeth 120, thereby lifting latch 107 and gate 106 with it. In other embodiments, however, platen 108 may comprise a slot or slots which allow platen 108 to bypass teeth 120 without interference.

As noted above, compressible material has a tendency to spring-back, or undesirably expand after compression, limiting the amount of compressible material that can be loaded into the compacting chamber 114 between compression cycles of the platen 108. The baler 100 may be further configured to prevent or limit spring-back of the compressed material in various embodiments. For example, in some embodiments, chamber door 104 may define a horizontal lip that may catch or engage compressed material and prevent it from springing back. In addition, in contrast to prior art balers wherein a loading chamber closure is offset from or not in alignment with the bale chamber door, thereby forming a gap between the platen and the loading chamber closure, in some embodiments of the present invention the inner surface of gate 106 generally may be even, or in alignment with, the inner surface of door 104, or a portion or face thereof, such as the lip discussed herein. Correspondingly, any gap between the platen 108 and gate 106 may be substantially reduced or, in some cases, eliminated, such that compressible material may not bypass platen 108.

More particularly, and as best seen in FIGS. 5B-C, 6B, and FIG. 7, the interior of door 104 preferably defines a lip 130 about at least a portion of one of its peripheral edges. In the illustrated embodiment, lip 130 is defined by the interior of door 104 having a recess 132. As such, recess 132 may be offset away from compacting chamber 114 when door 104 is in the closed position. Here, recess 132 may comprise almost the entirety of the interior face of door 104, but that is not required in all embodiments. Depending on the desired thickness of lip 130 and the extent to which it is desired that lip 130 extend on door 104, recess 132 may be smaller, or in some cases, more than one recess 132 may be defined in door 104. Further, embodiments are contemplated in which the interior of door 104 need not have any recess at all, and lip 130 may be formed by a projection from the interior surface of door 104. As shown, lip 130 in this embodiment is defined at the interface of the loading gate 106 and the chamber door 104, though this too is not required in all embodiments, and in some cases there may be a recess 132 above lip 130. Here, lip 130 is substantially horizontal and provides a surface which may statically engage compressed material as it expands.

Figure 6B:
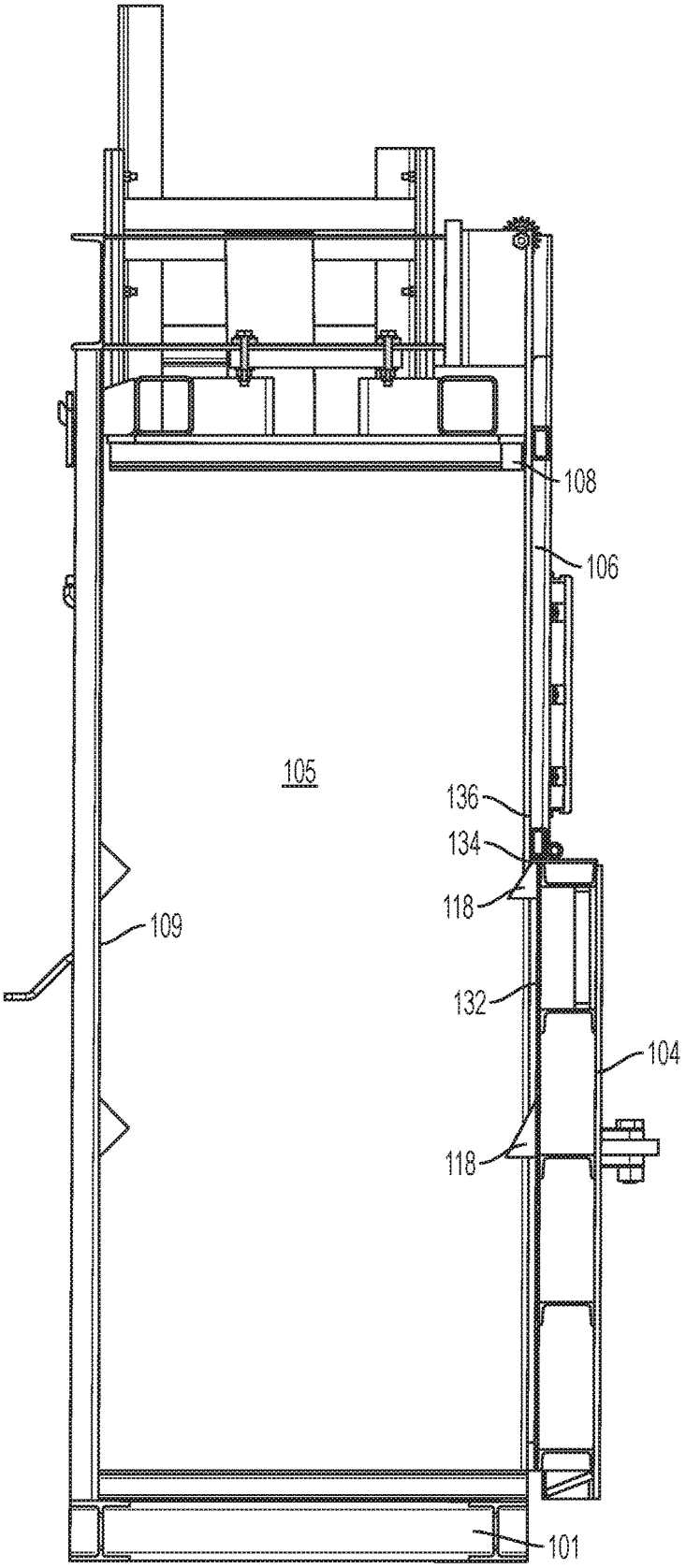
FIG. 6B is a cross-sectional view of the baler of FIG. 2 taken along the line B-B shown in FIG. 3.

Further, to eliminate the gap that exists between the platen and the loading chamber closure of conventional balers, which permits compressible material to bypass the platen, in various embodiments, an inner surface of loading gate 106 preferably is in alignment with an inner surface of door 104, rather than being offset therefrom. For instance, in the illustrated embodiment, lip 130 defines an interior face 134, and loading gate 106 comprises an interior face 136. Interior faces 134 and 136 are substantially flush, for example as seen in FIG. 6B. In some embodiments, interior faces 134 and 136 may have or form a continuous plane, but this is not required in all embodiments; indeed, there may be some offset between gate 106 and door 104 as long as the size of the gap between gate 106 and platen 108 does not permit compressible material to bypass platen 108. In other words, it is preferred but not always required that the interior of gate 106 be generally even with the interior of door 104 when gate 106 and door 104 are in the shut position. In various embodiments, the size of the gap between gate 106 and platen 108 may be about ¾", about ½", or about 1". In contrast, the corresponding gap in current balers can be between 2" and 3.5", or greater.

Figure 7:
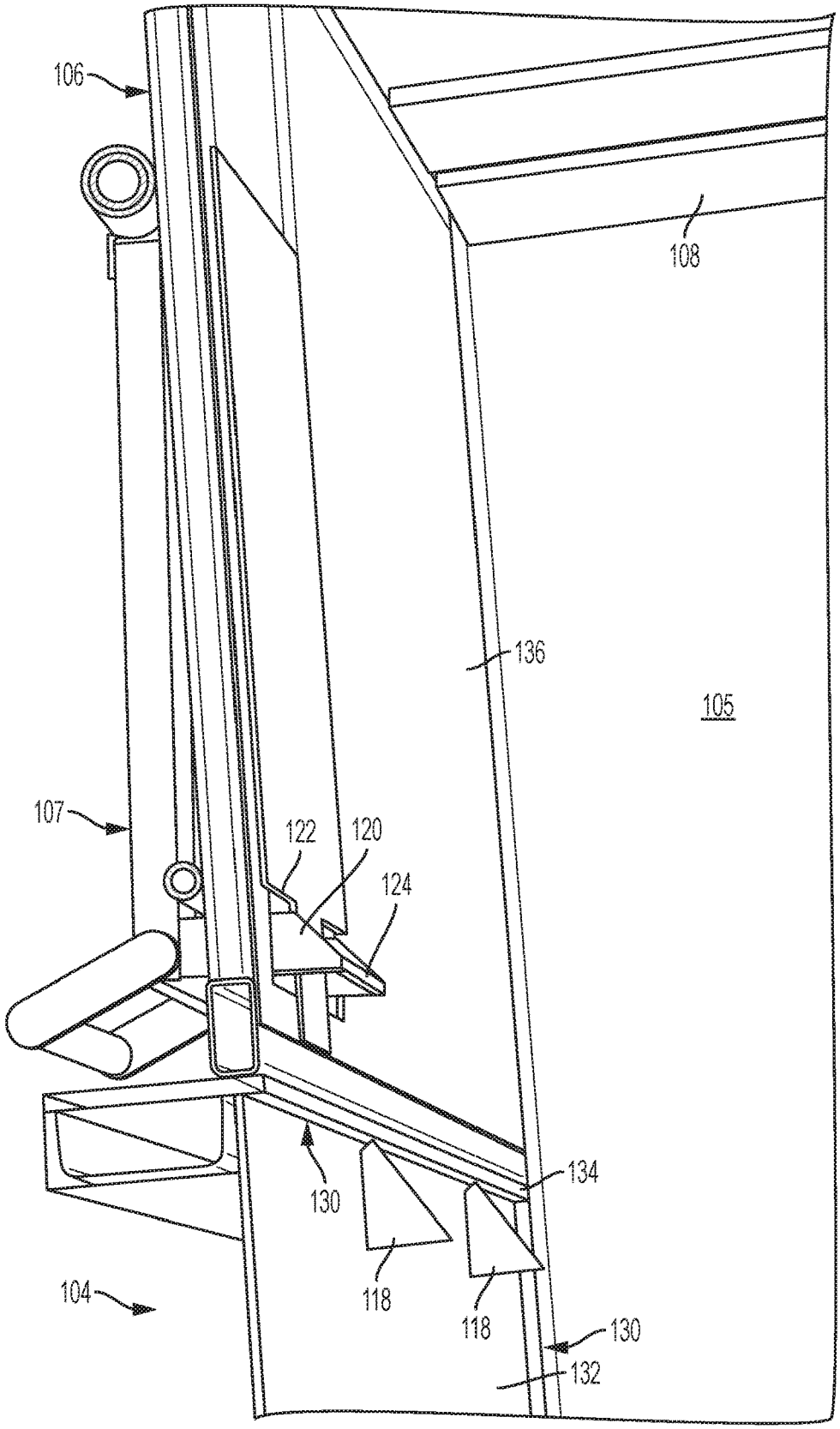
FIG. 7 is a cross-sectional detail perspective view of the interior of the baler of FIG. 2.

As best seen in FIGS. 6A, 6B, and 7, due to the alignment of the interior faces 134 and 136, the interior face 136 of the loading gate 106 may also be proximate a front side of the platen 108. Again, a relatively small gap may exist in some embodiments between platen 108 and one or more of gate 106, walls 105, or wall 109, but the size of the gap is preferably limited to prevent compressible material from bypassing platen 108 during operation of baler 100. Although the platen 108 is depicted in the retracted position it is preferred that the front side of the platen 108 remains proximate or, in some cases, substantially flush with, interior faces 134 and/or 136 as the platen 108 travels past these faces, e.g., from the retracted position to the extended position. Likewise, the interior faces of walls 105 and 109 are also preferably proximate or substantially flush with corresponding facing sides of platen 108. Reduction or elimination of the gap between gate 106 and platen 108 as described herein prevents or limits compressible material from entering the area above the platen, which, in turn, may prevent damage and extend the life or maintenance cycle of the baler 100.

FIGS. 8A-B are diagrammatic perspective views of current sensors according to embodiments of the present invention. In this regard, in some example embodiments, it may be desirable to identify an increase in the pressure being applied to or by the platen 108 during a compression cycle.

As such, the baler 100 may include one or more pressure sensors to measure the pressure applied by the linear actuator 112 to the platen 108. However, pressure sensors are complex sensors which require periodic calibration, may be susceptible to damage, and may require conversion from the measured data prior to use, e.g., conversion of differential voltage across a linear variable differential transformer to a pressure. In lieu of or in addition to conventional pressure sensors, the baler 100 may include one or more amp rings or current sensors 150 operative to measure a current value associated with one or more electric components of baler 100, such as but not limited to motor 116 where motor 116 is an electric motor. As explained in more detail below, the current sensor 150, which may be in electrical communication with controller 115, may be set to act as a switch so that controller 115 knows when a predetermined and/or estimated pressure threshold has been reached. Those of skill in the art will appreciate that current sensors 150 may be used in any electrical component baler 100 where it is desired to determine if current levels are being supplied or properly regulated.

In operation of one preferred embodiment, the current draw, or flow through, the motor 116 may be proportional to the resistance to movement of platen 108 and/or linear actuator 112. As such, an increase in the current flow through the motor 116 by more than a predetermined amount may be indicative of material on top of the platen 108, reduced cylinder lubricant, or other maintenance issue associated with the baler 100. In addition or in the alternative, an increase in current above a predetermined threshold may indicate that the baler 100 has been filled. In some embodiments, controller 115 may associate one or more current value measurements with the direction of travel of the platen 108, and this association may allow controller 115 or an operator thereof to better identify a maintenance issue. For example, an increase in current in both directions may be indicative of resistance caused by the linear actuator, such as by insufficient lubricant, whereas an increase in current during compression or retraction only may be indicative jamming, or resistance to movement, of the platen 108 in the indicated direction.

In one embodiment, the current sensor 150 may be an inductive loop. One or more power supply leads 151 may pass through the inductive loop 150. In the example depicted in FIG. 8A, the power supply lead 151 passes through the inductive loop 150 one time. As those of skill in the art will appreciate, the configuration illustrated in FIG. 8A may be representative of the power supply lead 151 being supplied with 240V power. In the example depicted in FIG. 8B, the power supply lead 151 passes through the inductive loop 150, completes a loop, and passes through the current sensor 150 a second time. This configuration may be representative of power supply lead 151 being supplied with 480V power. In this regard, at a higher voltage, there is less current draw, and power supply lead 151 may need to be fed through loop 150 twice (doubling the amp reading) to be within the range limitations of a given current sensor 150. The current flowing through the power supply lead 151 may generate an electromagnetic field proportional to the current flow. The electromagnetic field may cause an induced voltage in the inductive loop 150 that may be proportional to the electromagnetic field. As such, the measured induced voltage may be proportional to the current flow in the power supply lead 151, and therefore the pressure applied to or by the linear actuator 112 and/or the platen 108. Those of skill in the art are familiar with current sensors 150 suitable for this purpose.

In one preferred embodiment, current sensor 150 may be a current switch. Where this is the case, current sensor 150 may be configured or adjusted to actuate at a specific current. The specific current may be associated with an estimated and/or predetermined pressure applied to platen 108.

In still other embodiments, controller 115 may fully detect data from current sensor 150. For instance, sensor data, including at least the current value, may be received by the controller 115 or other processing circuitry (such as that illustrated in FIG. 9). The controller 115 may compare the current value to one or more predetermined thresholds, such as a threshold indicating that the baler is full, a maintenance threshold, or a safety threshold. A maintenance threshold and/or safety threshold, for instance, may be set or adjusted to a value greater than a normal operating value or greater than the fullness threshold, such as 1 percent, 3 percent, 5 percent, 10 percent, or the like, greater. The maintenance threshold may be set lower than the safety threshold and be indicative of needed maintenance, such as removal of debris from the area on top of the platen 108, lubrication of the linear actuator 112, or other maintenance issues. The safety threshold may be set higher than the maintenance threshold and/or lower than an indicated pressure that may cause damage to one or more baler components.

In an example embodiment, the controller 115 may cause an alert in response to the sensor data, such as a current value, exceeding one or more predetermined fullness, maintenance, and/or safety thresholds. The alert may be any suitable audible or visual indication including, but not limited to, a light, a buzzer, a siren, a text message on a user interface associated with the baler 100, or the like. In some embodiments, the controller 115 and/or processing circuitry may be in communication with one or more networks, as described below in reference to FIG. 9, enabling an alert to be sent to one or more user devices, such as cellular phones, tablet computers, computer terminals, or the like. In such an embodiment, the alert may be an email, a text message, a voice call, or an alert sent via another communication medium familiar to those of skill in the art. As a result of sensor data exceeding one or more predetermined fullness, maintenance, and/or safety thresholds, controller 115 may also be operative to schedule maintenance or service of baler 100.

In some embodiments, the controller 115 and/or processing circuitry may be further configured to cause the hydraulic cylinder to stop in response to sensor data exceeding the predetermined fullness, maintenance, and/or safety thresholds. The controller 115 may interrupt electrical power to the motor 116, vent pressure applied to the linear actuator 112, or hydraulically lock the linear actuator 112, thus preventing further movement of the linear actuator 112, which may prevent or limit damage to the baler 100.

Embodiments of the present invention are contemplated in which other technologies for detecting the amount of material in baler 100 or the fullness of baler 100 may be used. Thus, current sensor 150 is not required in all embodiments. Those of skill in the art are familiar with other technologies which may be used for this purpose, such as image-based scanning, among others.

Example Processing Circuitry

FIG. 9 is a block diagram of processing circuitry for a baler according to various embodiments of the present invention. The processing circuitry 200 of FIG. 9 may be employed, for example, on onboard circuitry within baler 100, e.g., in the controller 115, a network device, server, proxy, or the like. Alternatively, embodiments may be employed on a combination of devices. Furthermore, it should be noted that the devices or elements described below may not be mandatory and thus some may be omitted in certain embodiments.

In various embodiments, the processing circuitry 200 is configured to perform data processing, application execution and other processing, and management services according to an example embodiment of the present invention. Some components of processing circuitry 200 may be analogous in at least some respects to components of the Guardian™ Control System offered by Wastequip, LLC, of Charlotte, N.C., except modified in accordance with embodiments of the present invention. In one embodiment, the processing circuitry 200 may include a memory 204 and a processor 202 that may be in communication with or otherwise control a user interface 206. Where provided, a current sensor 209 may also be in communication with processor 202. Also, as noted above, other technologies, such as image-based scanners, also may be used to detect baler fullness, and thus processor 202 may be in communication with other components used for this purpose.

Although not required in all embodiments, in some embodiments processing circuitry 200 may also include a communication interface 208. As such, the processing circuitry 200 may be embodied as a circuit chip (e.g., an integrated circuit chip) configured (e.g., with hardware, software or a combination of hardware and software) to perform operations described herein. However, in some embodiments, the processing circuitry 200 may be embodied as a portion of a server, computer, or workstation. In situations where the processing circuitry 200 is embodied as a server or at a remotely located computing device, the user interface 206 may be disposed at another device (e.g., at a computer terminal or user device 212) that may be in communication with the processing circuitry 200 via the communication interface 208 and/or a network 210.

Where employed, the network 210 may be a data network, such as a local area network (LAN), a metropolitan area network (MAN), a wide area network (WAN) (e.g., the Internet), and/or the like, which may communicatively couple the baler 100 to devices such as processing elements (e.g., computer terminals, server computers or the like) and/or databases. Communication between the network 210, the baler 100, and the devices or databases (e.g., servers) to which the baler 100 is coupled may be accomplished by either wireline or wireless communication mechanisms and corresponding communication protocols.

The user interface 206 may be an input/output device for receiving instructions directly from a user. The user interface 206 may be in communication with the processing circuitry 200 to receive user input via the user interface 206 and/or to present output to a user as, for example, audible, visual, mechanical, or other output indications. The user interface 206 may include, for example, a keyboard, a mouse, a joystick, a display (e.g., a touch screen display), a microphone, a speaker, or other input/output mechanisms. Further, the processing circuitry 200 may comprise, or be in communication with, user interface circuitry configured to control at least some functions of one or more elements of the user interface 206. The processing circuitry 200 and/or user interface circuitry may be configured to control one or more functions of one or more elements of the user interface 206 through computer program instructions (e.g., software and/or firmware) stored on a memory device accessible to the processing circuitry 200 (e.g., volatile memory, non-volatile memory, and/or the like). In some example embodiments, the user interface circuitry is configured to facilitate user control of at least some functions of the apparatus through the use of a display configured to respond to user inputs. The processing circuitry 200 may also comprise, or be in communication with, display circuitry configured to display at least a portion of a user interface 206, the display and the display circuitry configured to facilitate user control of at least some functions of the apparatus.

In some embodiments, the communication interface 208 may be any means, such as a device or circuitry embodied in either hardware, software, or a combination of hardware and software, that is configured to receive and/or transmit data from/to the network 210 and/or any other device or module in communication with the processing circuitry 200. In some instances the communication interface 208 may provide secured or encrypted communication between the processing circuitry, the network, and/or remote servers. The communication interface 208 may also include, for example, an antenna (or multiple antennas) and supporting hardware and/or software for enabling communications with the network or other devices (e.g., a user device). In some environments, the communication interface 208 may alternatively or additionally support wired communication. As such, for example, the communication interface 208 may include a communication modem and/or other hardware/software for supporting communication via cable, digital subscriber line (DSL), universal serial bus (USB) or other mechanisms. In an exemplary embodiment, the communication interface 208 may support communication via one or more different communication protocols or methods. In some cases, IEEE 802.15.4 based communication techniques, such as ZigBee or other low power, short range communication protocols may be employed along with radio frequency identification (RFID) or other short range communication techniques.

The current sensor 209 may be in communication with processing circuitry 200. For example, the current sensor may be configured to measure a current value associated with the motor 116 of the baler 100. In an example embodiment, the current sensor 209 may measure a current value of one or more power supply leads 151 of the motor 116. In one such example, the current sensor 209 may include an inductive loop configured to receive the power supply lead 151 therethrough. Current flow in the power supply lead 151 may induce a voltage in the inductive loop proportional to the current flow in the power supply lead 151. The current sensor 209 may communicate the current value measured by the inductive loop to the processing circuitry 200.

Example Flowchart and Operations

Embodiments of the present invention provide methods, apparatus and computer program products for operating a baler. Various examples of the operations performed in accordance with embodiments of the present invention will now be provided with reference to FIG. 10.

FIG. 10 is a flow diagram illustrating steps of a method of utilizing a baler in accordance with an embodiment of the present invention. The operations illustrated in and described with respect to FIG. 10 may, for example, be performed by, with the assistance of, and/or under the control of one or more of the processor 202, memory 204, communication interface 208, user interface 206, and/or current sensor 209. In the exemplary method shown in FIG. 10, processor 202 may fully detect data from current sensor 209, but those of skill in the art will appreciate that this method may be modified for other embodiments wherein current sensor 209 operates as a current switch, as described above.

A method may include receiving sensor data from a current sensor associated with an electric motor at operation 902 and determining if the sensor data exceeds a predetermined threshold at operation 904. This predetermined threshold may be a fullness threshold, indicating that the baler has been filled, or a maintenance threshold. At operation 906, the method may include causing an alert in response to the sensor data exceeding the predetermined threshold.

In some embodiments, the methods may include additional, optional operations, and/or the operations described above may be modified or augmented. Some examples of modifications, optional operations, and augmentations are indicated by dashed lines, such as determining if the sensor data exceeds a predetermined safety threshold at operation 908 or causing the hydraulic cylinder to stop in response to the sensor data exceeding the predetermined safety threshold at operation 910.

FIG. 10 is a flow diagram according to an example embodiment. It will be understood that each block of the flow diagram, and combinations of blocks in the flow diagram, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 204 and executed by, for example, the processor 202. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device (for example, the processing circuitry 200 of the baler 100) to cause a series of operations to be performed on the computer or other programmable apparatus to produce a computer-implemented process such that the instructions which execute on the computer or other programmable apparatus implement the functions specified in the flow diagram block(s).

Based on the foregoing, it will be appreciated that embodiments of the invention provide a unique baler and method of utilizing a baler. Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A baler, comprising:

a housing defining an interior volume, the interior volume comprising a compression portion and a loading portion;

a first closure movably coupled with the housing and operative to enclose the compression portion, the first closure having an interior wall that faces the interior volume when the first closure is in a closed position, wherein the interior wall of the first closure has a first surface and a second surface, wherein the first surface is recessed relative to the second surface;

a second closure movably coupled with the housing and operative to enclose the loading portion, the second closure defining a third surface that faces the interior volume when the second closure is in a closed position;

a reciprocating compression assembly comprising:

a linear actuator; and a platen operably coupled with the linear actuator, wherein the platen is movable between a retracted position and an extended position in response to actuation of the linear actuator;

wherein the third surface of the second closure is substantially flush with the second surface of the first closure when the first and second closures are in their respective closed positions.

2. The baler of claim 1, wherein the second closure comprises a gate.

3. The baler of claim 2, wherein the gate is operative to translate vertically relative to the housing to open and close the loading portion.

4. The baler of claim 1, wherein the linear actuator comprises a hydraulic cylinder.

5. The baler of claim 1, wherein the first closure comprises a door.

6. The baler of claim 5, wherein the second surface is on a lip of the door.

7. The baler of claim 6, wherein the lip projects outwardly from the door.

8. The baler of claim 6, wherein the lip is disposed proximate an interface between the door and the second closure.

9. The baler of claim 6, wherein the lip extends about at least a portion of the periphery of the door.

10. The baler of claim 6, further comprising one or more teeth that project from one or more of the first closure, the second closure, or an interior wall of the housing.

11. The baler of claim 1, further comprising:

a motor;

a current sensor operative to measure a current value associated with the motor;

a processor and memory including computer program code, the memory and the computer program code configured to, with the processor, cause the processor to:

receive sensor data from the current sensor;

determine if the sensor data exceeds a predetermined threshold; and cause an alert in response to the sensor data exceeding the predetermined threshold.

12. The baler of claim 11, wherein the predetermined threshold is a fullness threshold.

13. The baler of claim 11, wherein the memory and the computer program code are further configured to, with the processor, cause the processor to:

determine if the sensor data exceeds a predetermined safety threshold; and cause the hydraulic cylinder to stop in response to the sensor data exceeding the predetermined safety threshold.

14. A baler, comprising:

a housing defining an interior volume, the interior volume comprising a compression portion and a loading portion;

a first closure movably coupled with the housing and operative to enclose the compression portion;

a second closure movably coupled with the housing and operative to enclose the loading portion;

a reciprocating compression assembly comprising:

a linear actuator; and a platen operably coupled with the linear actuator, wherein the platen is movable between a retracted position and an extended position in response to actuation of the linear actuator;

wherein the first closure defines at least one recess therein and a lip extending about at least a portion of the at least one recess, the lip operative to engage with compressible material disposed in the compression portion;

wherein the at least one recess comprises a first surface and the lip comprises a second surface parallel with and spaced apart from the first surface, wherein the second surface is substantially flush with an interior face of the second closure when the first and second closures are in their respective closed positions.

15. The baler of claim 14, wherein the second surface and the interior face are coplanar.

16. A baler, comprising:

a housing defining an interior volume, the interior volume comprising a compression portion and a loading portion;

a first closure movably coupled with the housing and operative to enclose the compression portion;

a second closure movably coupled with the housing and operative to enclose the loading portion;

wherein the first closure has an interior wall that faces the interior volume when the first closure is in a closed position, the interior wall of the first closure comprising a first surface that is recessed with respect to a second surface;

wherein the second closure has an interior wall that faces the interior volume when the second closure is in a closed position, the interior wall of the second closure comprising a third surface;

wherein the second and third surfaces are substantially flush when the first and second closures are in their respective closed positions;

a reciprocating compression assembly comprising:

a linear actuator; and a platen operably coupled with the linear actuator, wherein the platen is movable between a retracted position and an extended position in response to actuation of the linear actuator;

a motor;

a current sensor operative to measure a current value associated with the motor; and a processor and memory including computer program code, the memory and the computer program code configured to, with the processor, cause the processor to:

receive sensor data from the current sensor;

determine if the sensor data exceeds a predetermined threshold; and cause an alert in response to the sensor data exceeding the predetermined threshold.

17. The baler of claim 16, wherein the current sensor comprises an inductive loop configured to receive a power supply lead from the motor therethrough.

18. The baler of claim 17, wherein the first closure defines at least one recess therein and a lip extending about at least a portion of the at least one recess, the lip operative to engage with compressible material disposed in the compression portion.

* * * * *